United States Patent [19]

Kücherer

[11] Patent Number: 4,637,543

[45] Date of Patent: Jan. 20, 1987

[54] FIBER CAN WITH REINFORCING CRIMPED METAL CLOSURE

[75] Inventor: Helmut Kücherer, Schriesheim, Fed. Rep. of Germany

[73] Assignee: Weidenhammer Packungen KG GmbH & Co., Hockenheim, Fed. Rep. of Germany

[21] Appl. No.: 783,060

[22] Filed: Oct. 2, 1985

Related U.S. Application Data

[63] Continuation of Ser. No. 603,201, Apr. 23, 1984, abandoned.

[30] Foreign Application Priority Data

Apr. 13, 1984 [DE] Fed. Rep. of Germany ..... 3413918

[51] Int. Cl.[4] ..... B65D 3/14

[52] U.S. Cl. ..... 229/5.6; 220/66; 220/359; 220/458; 229/43

[58] Field of Search ..... 229/5.5, 5.6, 43; 220/66, 67, 455–458, 359, 360, 367, 270, DIG. 16; 426/118

[56] References Cited

U.S. PATENT DOCUMENTS

| | | | |
|---|---|---|---|
| 25,894 | 10/1859 | Fridley et al. | 220/DIG. 16 |
| 827,667 | 7/1906 | Reed | 220/DIG. 16 |
| 2,343,716 | 3/1944 | Toscano et al. | 229/5.6 |
| 2,894,844 | 7/1959 | Shakman | 220/66 X |
| 3,087,824 | 4/1963 | Ackerman et al. | 220/66 X |
| 3,115,987 | 12/1963 | Barnstead | 220/67 X |
| 3,137,432 | 6/1964 | Rein et al. | 229/5.6 |
| 3,406,891 | 10/1968 | Buchner et al. | 229/5.5 |
| 3,434,651 | 3/1969 | Stec | 229/5.5 |
| 3,547,305 | 12/1970 | Khoury | 220/359 |
| 3,592,353 | 7/1971 | Bowen | 220/66 |
| 3,709,398 | 1/1973 | Fuhrmann | 220/67 |
| 4,211,338 | 7/1980 | Bublitz | 220/359 |
| 4,238,050 | 12/1980 | LeGrow | 220/458 |
| 4,253,584 | 3/1981 | Bloeck et al. | 220/359 |
| 4,363,582 | 12/1982 | Bloeck et al. | 220/456 X |
| 4,374,568 | 2/1983 | Horton | 229/5.5 |
| 4,540,105 | 9/1985 | Wright | 220/359 |
| 4,542,029 | 9/1985 | Caver et al. | 220/359 X |
| 4,544,080 | 10/1985 | Wright et al. | 220/359 |

FOREIGN PATENT DOCUMENTS

| | | | |
|---|---|---|---|
| 716416 | 8/1965 | Canada | 220/DIG. 16 |
| 736797 | 6/1966 | Canada | 220/DIG. 16 |
| 6602639 | 11/1966 | Netherlands | 220/DIG. 16 |

*Primary Examiner*—William Price
*Assistant Examiner*—Bryon Gehman
*Attorney, Agent, or Firm*—McCormick, Paulding & Huber

[57] ABSTRACT

A fiber can is made up of a laminated can body with a gas-tight, fusible lining, a lower end wall shutting off one end of the body and a partly metallic cover on the other end of the body. The cover is made up of a rigid cover member crimped on the body having an opening and an inner fusible coating that has an affinity for the lining of the body of the can and which is heat sealed thereto when the cover member is fixed in place on the can body. The opening in the cover member is shut by a covering diaphragm that is fixed in place by adhesively bonding or welding to the cover member and is so elastic or is so pre-shaped that it is able to follow and keep up with the pressure difference between the inside of the can and the outside after the can has been sealed.

16 Claims, 2 Drawing Figures

FIBER CAN WITH REINFORCING CRIMPED METAL CLOSURE

This is a continuation of co-pending application Ser. No. 603,201 filed on Apr. 23, 1984, now abandoned.

BACKGROUND OF THE INVENTION

The present invention is with respect to fiber cans of the sort having a multilayer or laminated body with a fusible gas-tight lining, an end wall shutting off a first end of the body, and a partly metallic cover that is made up of a rigid cover member. For its part the cover member is crimped on a second end of the body and has an opening shut off by a covering diaphragm, which is fixed in place by adhesive bonding or by heat sealing.

DISCUSSION OF THE PRIOR ART

Known cans of this design (see the German Pat. No. 1,814,951) give the useful effect that covering diaphragm may readily be pulled off using a tab, that is to say, no special tool is needed for opening the can. However a less desired effect is that the cover member, in this case a narrow ring with an outer edge crimped on the body, does not give a gas-tight sealing effect so that the range of use of such cans is quite limited: more specially they are of no use to keep out oxygen from products that are sensitive thereto and have to be kept under oxygen-free conditions for some length of time.

In a further design of such cans (see the German Offenlegungsschrift specification No. 3,205,012) the deep-drawn cover was again crimped on the end edge of the body. On the inner face the cover had a plastics coating that was heat sealed to the lining coating of the can body at the same time as the crimping operation or thereafter. The outcome was a gas-tight fiber can. A shortcoming was however that the can might not be used for products producing a vacuum or a positive pressure at certain times or all the time, or for products that had to be stored in a vacuum. Such objections apply more specially in the case of products that have to be canned while hot or contain dissolved gases, as for example carbonated beverages. The pressure differences have to be resisted by the material of the fiber can body so that it is normally likely to be deformed and furthermore it has to be made with very thick walls.

Lastly attempts have been made at using the can closure of the sort noted on metal cans by using a separate sealing composition between the crimped-on cover ring and the metal can body. This process may not be used with cans having a non-metallic body, that is to say fiber cans. A further point is that great care is needed to produce the joint if it is to be fully gas-tight.

SHORT OVERVIEW OF THE PRESENT INVENTION

One purpose or object of invention is that of improving the fluid-tightness of fiber cans of the sort in question.

A further aim of the invention is to make possible a gas-tight form of such a fiber can.

For effecting these and other purposes of the invention the cover member has a fusible coating on its inner side, such coating having an affinity for the lining of the body and being thermally sealed to the said lining of the body when the cover member is fixed in place, and furthermore the covering diaphragm is so elastic or is so preformed that any pressure differences between the inside of the can and outside coming into existence after the closing of the can are responsible for changes in the form of the diaphragm; or in other words the diaphragm keeps up with and makes allowances for such pressure differences by changing its shape.

By using a coating on the cover ring that has an affinity for the lining of the can body it becomes possible for the said ring, and for this reason all of the cover, to be sealed thermally to the body and a gas- and pressure-tight joint is formed between the rigid cover member and the body. The pressure-resistance and gas-tightness in the join between the covering diaphragm and the cover member may be produced in the same way by suitable coatings and heat sealing. However this measure would not as such give the full desired degree of pressure-resistance or stability because products that are canned under vacuum or with a gage pressure and which are responsible for producing a pressure gradient after being canned, cause deformation of the can body if its wall is not made so thick as to be uneconomic or to be excessively heavy. This shortcoming is taken care of by the present invention inasfar as the covering diaphragm is made so elastic or is specially pre-shaped that it is able to take up such a pressure difference without damage to the fiber can body Tests undertaken under working conditions have made it clear that such a fiber can may be used not only for products producing pressure, such as carbonated beverages or the like but furthermore products that have to be packed under vacuum or themselves are responsible for producing a vacuum, as for example peanuts, that may be canned in the fiber can of the present invention without any difficulties. Furthermore other products such as vegetable and fruit juices and jams etc. may be canned in the new form of can even although there are heavier forces acting on the can body.

In keeping with one preferred form of the present invention the lower end wall of the can is in the form of a metal plate with a crimped edge and on its inner side it has a coating with an affinity towards the lining of the can body, such coating being thermally sealed or welded to the lining of the body when the end wall is crimped onto the body.

With this form of the invention generally the same process step is used for the lower wall of the can as for the cover closure so that not only with respect to the sorts of lining used but furthermore to the closing operation it makes possible an even better and more rational way of producing the package and furthermore makes the same more gas-tight.

As is normally the case, the can body may be made of one paper or cardboard layer or a laminate thereof, the inner layer of the body having the lining thereon. Such fiber cans with this form of body may be produced at a low price.

The body is best made by longitudinally winding the material, there being a lengthways seam running along a line on the outer face of the structure parallel to the axis of the can body. A can body produced in this way has the edge over a spirally coiled body inasfar as the seam is straight, is regularly positioned and is only completed after the body has been formed. Another point is that the seam is shorter and cheaper to produce than in the case of a spirally coiled body, that furthermore has to be seamed along a spiral line while the body is in the process of being shaped. For this reason a lengthways coiled or wound can may be welded because of the regular, straight seam to give a safe and gas-tight join without the seam being acted upon by any more deforming forces. A still further point to be noted is that gas-tight forms of fiber cans may be produced that have an other than round cross section.

In keeping with one form of the invention the cover part is designed in the form of a ring and the covering diaphragm is fixed on a tear-open tab by which the fiber can may be opened to get at the filling in it.

If the can is to be opened over its full cross section the tab may be joined with the outer limit of the covering diaphragm or if it is only to be opened over part of its cross section it may be joined with the diaphragm by frangible connection points.

In place of this possible form of the invention, in which the stiff cover member is in the form of a ring, the design may be such that the opening is placed eccentrically in the cover member for functioning as a filling and/or drinking opening and the covering diaphragm is formed by a tear-off tab covering over the opening.

This form of the invention is more specially suitable for liquid products such as beverages or the like, and more specially for those beverages that are stored under a gage pressure, as for example carbonated beverages. In this case the tear-open tab forming the covering diaphragm has a smaller free cross section than the other form of the invention so far noted, but however it may give away to changes in pressure within the necessary limits. In a preferred form of this design of the invention the lining of the cover member is drawn like a film over the opening and the tear-open tab with the inner coating thereon is welded or heat-sealed thereonto. To take an example, the inner coating on the cover member may be produced thereon after the opening has been stamped therein.

It will be seen that in this form of the invention the inner coating on the cover member and the inner coating of the tear-open tab are placed on top of one another so that they may be joined together partly or over their full surfaces by heat sealing. In this respect there is the further useful effect that the inner coating on the cover member covers over the edge of the opening so that same is guarded against the access of the product and there is no chance of interaction between the material of the cover member and the product.

If the cover member is only made in the form of a ring, it will by the nature of things have a large middle opening, that is covered over by the covering diaphragm, it is best for the inner coating on the cover member to be pulled over the edge of its opening as far as the outside, whereas the covering diaphragm has a fusible coating, having the desired type of affinity, and is heat sealed to the cover member.

In keeping with a further form of the invention there is, at least on the part of the can body that is to be joined to the cover member and possibly to the lower wall, an outer coating having an affinity for the coating on the cover member and the lower wall, such coating being heat sealed to the inner lining of the cover and end wall, when the cover member and the lower wall are fixed in place on the body.

This form of the invention is responsible for an even larger heat sealing surface at the closure so that it is made even more highly gas-tight.

An account will now be given of two working examples of the invention to be seen in the figures.

LIST OF THE DIFFERENT FIGURES

DETAILED ACCOUNT OF WORKING EXAMPLES OF THE INVENTION

Figure 1:
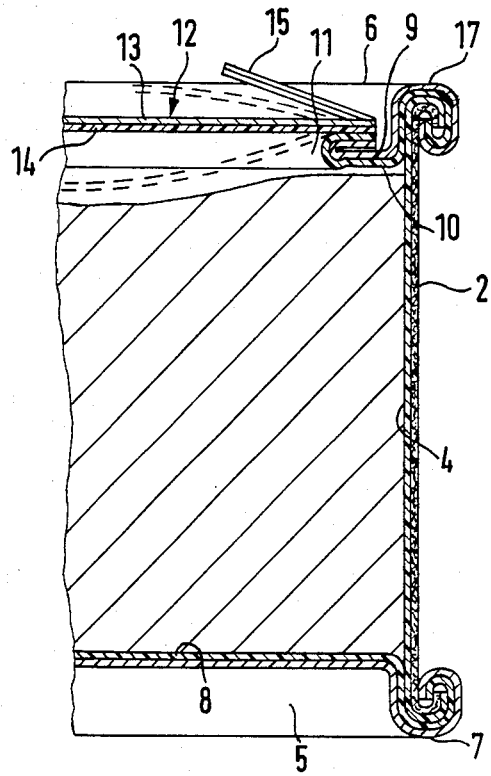
FIG. 1 is a broken away lengthways section through a first form of fiber can in keeping with the invention.
Figure 2:
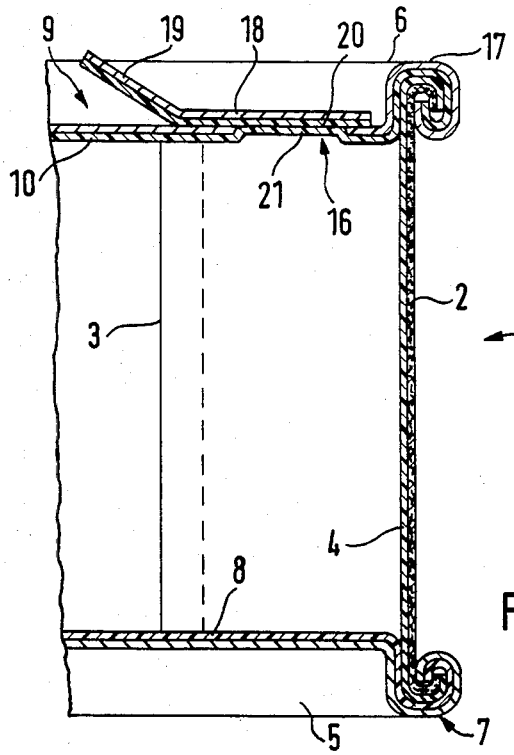
FIG. 2 is a section, on the same lines as in FIG. 1, of a second working example of the present invention.

The fiber can 1 or container to be seen in FIGS. 1 and 2 has a can body portion 2, that is made of paper or cardboard laminate which if needed will have a sealing or barrier layer included therein in the form of metal foil. The can body is more specially produced by a lengthways winding operation so that the body 2 is completed by a lengthways seam 3 (see FIG. 2) running along the outer face of the said body parallel to the axis thereof.

The said body 2 has a lining 4 of plastic with the desired properties to adhere to food and drugs legislation, such lining at the same time forming a gas- and liquid-tight barrier or sealing layer for guarding the multilayer or laminated can body 2. The lining 4 is sealed or thermally welded along the lengthwise seam 3 after the body has been produced.

At its one end the fiber can 1 is shut off by an end wall 5 and the opposite end is shut off by a cover 6. In the working examples shown here the lower end wall 5 is in the form of a deep drawn metal plate with a crimp-on edge 7. Furthermore the lower end wall 5 has a coating 8 on its inner face of a plastic having an affinity for the lining 4 of the can body 2. The deep drawn metal plate is placed on the open end of the can body 2 and joined therewith by crimping down the edge 7 on the end of the body 2. At the same time or thereafter the lining 4 of the can body 2 and the inner layer 8 of the lower end wall 5 are heat sealed to each other.

In FIGS. 1 and 2 the reader will be able to see to different possible forms of the cover. In the example viewed in FIG. 1 the cover 6 has a rigid cover member 9 in the form of a cover ring with a crimp-on edge or peripheral crimping lip 17 running round it. The ring-like cover member 9 has an inner coating 10, that is for its part made of a plastic having an affinity for the lining 4 of the can body 2. Furthermore the rigid cover member 9 has an opening 11 with a relatively large cross section with a covering diaphragm 12 stretching over it. The covering diaphragm 12 is best made of a metal foil 13, that for its part has a plastic coating 14. The covering diaphragm 12 is in this form of the invention fitted with a tear-open tab 15 formed on the covering diaphragm 12, for example by forming cuts in a stamping operation.

In the working example in FIG. 1 the inner coating 10 of the cover member 9 is drawn over the edge of the opening 11 onto the top outer face of the cover member so that the covering diaphragm has its inner coating 14 at its edge resting on the outer coating 10 of the cover member 9.

For closing the cover 6 the crimp-down edge or peripheral crimping lip 17 is crimped round in the same way as is the case with the end wall 5 on to the end edge of the can body 2 and the coatings 4 and 10 are heat sealed together. On the same lines the inner coating 14 of the covering diaphragm 12 is heat sealed to the outer coating 10 of the cover member 9.

The cover diaphragm 12 is made with such elastic properties or is so slightly preformed that it may give way under the effect of vacuum or gage pressure as produced after filling the can, this being marked in dashed lines. The sealed fiber can 1 is opened by pulling on the tear-open tab 15, the can then being opened over its full cross section 11 so that the product may be poured out or taken therefrom in some other way.

In the case of the working example to be seen in FIG. 2 there is a different form of the cover 6. It has a cover member 9, that has a small eccentric filling or drinking opening 16. The rigid cover member 9 again has its inner coating 10 and a crimp-on edge 17. The cover member 9 is fixed onto the can body 2 in the same way as with the working example to be seen in FIG. 1. However a change is present here inasfar as the opening 16 is covered up by a covering diaphragm 18 in the form of a tear-open tab 19. The covering diaphragm 18 has an inner coating 20 made of a plastic with an affinity for the inner coating 10 of the cover member. The coating 10 is in this form of the invention drawn like as sort of film over the opening 16 in the part 21 so that the edge of the opening of the cover member 9 is covered over thereby. The inner coating 20 of the covering diaphragm 18 and the film-like part 21 of the inner coating 10 on the cover member are placed right against each other so that they may be quite simply heat sealed or welded to each other.

I claim:

1. A can comprising: a laminated fiber can body having a gas-tight fusible lining, an end wall shutting off one end of said body, the end wall being in the form of a metal plate with a peripheral crimping lip rolled together with a captured portion of the fiber can body to form an overlapped joint and a metal structural reinforcing ring at said one end of the fiber body, a partly metallic cover on the opposite end of the can body, said cover being formed as a rigid cover member having a peripheral crimping lip that is rolled outwardly together with a captured portion of the fiber can body at the opposite end into an overlapped joint between the rigid cover member and said opposite end of the can body, the rolled crimping lip and captured portion of the fiber can body together providing a structural reinforcing ring at said opposite end of the fiber body to withstand stresses developed at the joint and adjacent areas of the fiber body by pressure differences between the inside and outside of the can, said cover member having on its inner side a fusible coating that has an affinity for and is brought into sealing contact with the lining of the body within the overlapped reinforcing joint to form a gas-tight seal, said rigid cover member forming the structural reinforcing ring for the fiber body having an opening and a flexible covering diaphragm fixed in position over said opening, said covering diaphragm being adapted to undergo a change in form when a pressure difference comes into existence between the inside and outside of the can after the sealing thereof whereby the pressure difference is accommodated without developing significant strain at the crimped and sealed joints between the cover member, the metal end wall, and the fiber body.

2. The can as claimed in claim 1 wherein the can body is made up of a laminate with at least one material layer selected from the group consisting of paper, and cardboard, one of such layers being innermost and having said lining thereon.

3. The can as claimed in claim 1 wherein said can body is longitudinally coiled and has a longitudinal seam running along a line on its outer face parallel to a longitudinal axis of the can.

4. The can as claimed in claim 1 wherein said cover member is in the form of a ring and said diaphragm comprises a tear-open tab thereon.

5. The can as claimed in claim 4 wherein the said tab is positioned at an outer limit of said covering diaphragm for fully opening up the can over its cross section.

6. The can as claimed in claim 5 wherein said tear-open tab is joined with the covering diaphragm at frangible connection points so that the can may be opened up over part of its cross section.

7. The can as claimed in claim 6 wherein in the inner coating on the cover member is drawn over the edge of the opening therein as far as the outer side and wherein the covering diaphragm has a fusible coating thereon and is heat sealed thereby onto the cover member.

8. The can as claimed in claim 1 wherein said opening is eccentrically located in said cover member and is designed for functioning as an opening selected from the group consisting of a filling opening and a drinking opening, and the diaphragm includes a tear-open tab covering said opening.

9. The can as claimed in claim 8 wherein the coating on the inside of the cover member is drawn like a film over the opening and the tear-open tab is heat sealed thereonto using an inner coating thereon.

10. The can as claimed in claim 9 wherein the inner coating on the cover member is produced after stamping out the opening.

11. The can as claimed in claim 1 wherein at least on the outer face where it is joined with the cover member the can body has a coating with an affinity for the coating of the cover member and becoming heat sealed to the said coating of the cover member when the same is fixed in position on said body.

12. The can as claimed in claim 1 wherein at least on the outer face where it is joined with the cover member and the said end wall the can body has a coating with an affinity for the coating of the cover member and of the end wall and becoming heat sealed to the said coating of the cover member and the end wall on the same being fixed in position upon said body.

13. The can as claimed in claim 1 wherein said diaphragm is adhesively bonded in place.

14. The can as claimed in claim 1 wherein said diaphragm is heat sealed in place.

15. The can as claimed in claim 1 wherein said diaphragm is elastically constructed.

16. The can as claimed in claim 1 where said diaphragm is preshaped.

* * * * *